US009240677B2

(12) United States Patent
Yoshimoto

(10) Patent No.: US 9,240,677 B2
(45) Date of Patent: Jan. 19, 2016

(54) SPARK PLUG

(71) Applicant: NGK SPARK PLUG CO., LTD., Nagoya-shi, Aichi (JP)

(72) Inventor: Osamu Yoshimoto, Aichi-ken (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/655,499

(22) PCT Filed: Oct. 2, 2013

(86) PCT No.: PCT/JP2013/076783
§ 371 (c)(1),
(2) Date: Jun. 25, 2015

(87) PCT Pub. No.: WO2014/103461
PCT Pub. Date: Jul. 3, 2014

(65) Prior Publication Data

US 2015/0357797 A1 Dec. 10, 2015

(30) Foreign Application Priority Data

Dec. 26, 2012 (JP) ..... 2012-281926

(51) Int. Cl.
*H01T 13/20* (2006.01)
*H01T 13/39* (2006.01)

(52) U.S. Cl.
CPC ..... *H01T 13/39* (2013.01)

(58) Field of Classification Search
CPC ..... H01T 13/39; H01T 13/32; H01T 21/02
See application file for complete search history.

(56) References Cited

U.S. PATENT DOCUMENTS

| | | | | |
|---|---|---|---|---|
| 5,320,569 | A * | 6/1994 | Oshima | H01T 21/02 219/121.64 |
| 5,395,273 | A * | 3/1995 | Matsutani | H01T 21/02 219/121.64 |
| 2009/0051259 | A1 | 2/2009 | Yoshimoto | 313/141 |
| 2009/0227168 | A1 * | 9/2009 | Nakamura | H01T 21/02 445/7 |
| 2011/0148276 | A1 | 6/2011 | Sakayanagi et al. | 313/141 |

FOREIGN PATENT DOCUMENTS

| | | | |
|---|---|---|---|
| JP | 2003-229230 A | 8/2003 | H01T 13/20 |
| JP | 2009/070810 A | 4/2009 | C22C 19/05 |
| JP | 2011-034826 A | 2/2011 | H01T 13/16 |

OTHER PUBLICATIONS

International Search Report issued in corresponding International Patent Application No. PCT/JP2013/076783, dated Nov. 5, 2013.

* cited by examiner

*Primary Examiner* — Donald Raleigh
(74) *Attorney, Agent, or Firm* — Kusner & Jaffe

(57) ABSTRACT

A spark plug is provided with: a central electrode; a ground electrode forming a spark discharge gap with the center electrode; and a chip welded to at least one of the electrodes. The chip has a thermal expansion coefficient smaller than a thermal expansion coefficient of the electrode to which the chip is welded, and the difference between the content A (mass %) of a noble metal component in the chip and the content B (mass %) of a noble metal component in the electrode (A−B) is 50 mass % or more. In an intermediate layer between the chip and the electrode, holes are present. When the length of a boundary between the chip and the intermediate layer is L (mm), and the length of the holes in a direction along the boundary of the chip and the intermediate layer is N (mm), $0.1 \leq N/L \leq 0.4$.

4 Claims, 9 Drawing Sheets

SPARK PLUG

RELATED APPLICATIONS

This application is a National Stage of International Application No. PCT/JP2013/076783 filed Oct. 2, 2013, which claims the benefit of Japanese Patent Application No. 2012-281926, filed Dec. 26, 2012.

FIELD OF THE INVENTION

The present invention relates to a spark plug used in an internal combustion engine and the like.

BACKGROUND OF THE INVENTION

A spark plug used in an internal combustion engine and the like includes, for example, a center electrode extending in an axial direction, an insulator disposed on the outer circumference of the center electrode, a cylindrical metal shell disposed on the outer circumference of the insulator, and a ground electrode joined to a tip end of the metal shell. The ground electrode is bent such that its tip end is opposite the tip end of the center electrode and a gap is formed between the tip end of the center electrode and the tip end of the ground electrode. In recent years, techniques have been proposed to improve ignitability and wear resistance by welding chips of a metal with high wear resistance (such as an iridium alloy and a platinum alloy) to parts of the ground electrode and the center electrode at which the gap is formed (see Patent Document 1: JP-A-2003-229230, for example).

BACKGROUND OF THE INVENTION

The electrodes to which the chips are welded are formed of a metal with nickel as a main component, for example. Generally, the thermal expansion coefficient of the chips is smaller than the thermal expansion coefficient of the electrodes to which the chips are welded. Thus, at high temperature, the difference in thermal stress between the chips and the electrodes becomes relatively large. As a result, oxide scales are rapidly formed between the chips and the electrodes as a thermal cycle is repeated, possibly resulting in the peeling (detachment) of the chips from the electrodes in an early period.

In order to prevent the peeling (detachment) of the chip, the chip may be welded to the electrode very strongly so that the formation of oxide scales between the chip and the electrode can be suppressed. However, in this case, a part of the chip on the electrode side is pulled by thermal expansion of the electrode and is thus thermally expanded (deformed) more. Thus, the difference in thermal expansion between the part of the chip on the electrode side and a part of the chip on the opposite side from the electrode is increased. As a result, the part of the chip on the opposite side from the electrode may be deformed (such as warped), or breakage may be caused in the part.

The present invention is made in view of the above problems, and a purpose of the present invention is to improve the weldability of a chip to an electrode in a spark plug in which the thermal expansion coefficient of the chip is smaller than the thermal expansion coefficient of the electrode to which the chip is welded, so that deformation or breakage of the chip can be effectively prevented while peeling (detachment) of the chip from the electrode can be more reliably prevented.

SUMMARY OF THE INVENTION

In the following, configurations suitable for solving the above problem will be described by listing items. It is noted that the effect and advantage specific to the corresponding configuration will be additionally described, if necessary.

Configuration 1. In accordance with a first aspect of the present invention, there is provided a spark plug having a center electrode; a ground electrode forming a gap with the center electrode; and a chip welded to at least one of the electrodes. The chip has a thermal expansion coefficient smaller than a thermal expansion coefficient of the electrode to which the chip is welded. The difference between the content A (mass %) of a noble metal component in the chip and the content B (mass %) of a noble metal component in the electrode (A−B) is 50 mass % or more. A hole is present in an intermediate layer disposed between the chip and the electrode. In a cross section including a central axis of the chip, $0.1 \leq N/L \leq 0.4$, where L is the length (mm) of a boundary of the chip and the intermediate layer, and N is the length (mm) of the hole in a direction along the boundary of the chip and the intermediate layer.

According to configuration 1, because A−B is 50 mass % or more, the noble metal component contained in the chip or the electrode can be caused to sufficiently diffuse when in use (at high temperature). As a result of the diffusion, the hole present in the intermediate layer can be caused to enter the chip (particularly on the intermediate layer side), whereby a hole can be formed inside the chip. The hole formed in the chip reduces the stress applied to the chip from the electrode as the electrode is thermally expanded, whereby the thermal expansion difference between the part of the chip positioned on the electrode side and the part of the chip positioned on the opposite side from the electrode can be decreased. As a result, the development of deformation or breakage in the chip can be more reliably prevented.

Further, because of the presence of the hole formed in the chip, the difference in thermal stress between the electrode and the chip can be decreased. Thus, the formation of oxide scales between the chip and the electrode can be effectively suppressed, whereby the weldability of the chip with respect to the electrode can be increased. As a result, the peeling (detachment) of the chip from the electrode can be more reliably prevented.

When $0.1 > N/L$, the hole may not be sufficiently formed in the chip, and the above operational effect may not be obtained. Further, when $N/L > 0.4$, the hole may not readily enter the chip, and the above operational effect may not be obtained.

Configuration 2. In accordance with a second aspect of the present invention, there is provided a spark plug according to configuration 1, wherein, in the cross section, a range of the chip from one side to the other side is equally divided into four parts by straight lines P1, P2, and P3 in order from an end which are parallel with the central axis, and $0.6 \leq Q/N$, where Q (mm) is the length of the hole in the direction along the boundary in the range from P1 to P3.

According to configuration 2, most of the hole is formed toward the center of the chip where the difference in thermal stress between the chip and the electrode tends to be particularly large. Thus, when in use (at high temperature), more holes can be formed inside the central side of the chip, whereby the difference in thermal stress between the electrode and the chip can be more effectively decreased. As a result, the weldability of the chip can be further increased, and the peeling (detachment) of the chip can be more reliably prevented.

Configuration 3. In accordance with a third aspect of the present invention, there is provided a spark plug according to configuration 1 or 2, wherein, in a plane perpendicular to the central axis of the chip, when the electrode to which the chip is welded chip and an end face of the chip positioned on the electrode side are projected along the central axis, an area in which a projection plane of the electrode and a projection plane of the end face are overlapped is rectangular or circular, and K/T≥1.2, where K (mm) is a long side of the rectangular area or a diameter of the circular area, and T (mm) is a maximum thickness of the chip along the central axis.

When there is a plurality of chip faces positioned on the electrode side, such as when a part of the chip is embedded in the electrode, the "end face of the chip positioned on the electrode side" refers to a face of the outer surface of the chip that adjoins the intermediate layer with the widest range (namely, the most important face in ensuring the chip weldability with respect to the electrode).

In the relatively thin chip in which K/T≥1.2 is satisfied, as in configuration 3, the part of the chip on the electrode side tends to be deformed in conformity with the thermal expansion of the electrode when the electrode is thermally expanded at high temperature. Thus, the difference in thermal stress between the electrode and the chip can be made smaller, whereby further improvement in weldability can be achieved.

On the other hand, because the part of the chip positioned on the electrode side tends to be more readily deformed, the thermal expansion difference between the part of the chip on the electrode side and the part of the chip on the opposite side from the electrode is increased. Thus, the concern about deformation or breakage in the chip may be increased.

In this respect, according to configuration 1, for example, because K/T≥1.2, deformation and the like of the chip can be more reliably prevented even when the concern about deformation or breakage of the chip is increased. As a result, the demerit arising from K/T≥1.2 (decrease in deformation resistance) can be eliminated while the merit provided by K/T≥1.2 (excellent weldability) is sufficiently maintained. Namely, according to configuration 3, excellent weldability and good deformation resistance can be achieved at the same time.

DETAILED DESCRIPTION OF THE PREFERRED EMBODIMENTS

In the following, an embodiment will be described with reference to the drawings.

First Embodiment

Figure 1:
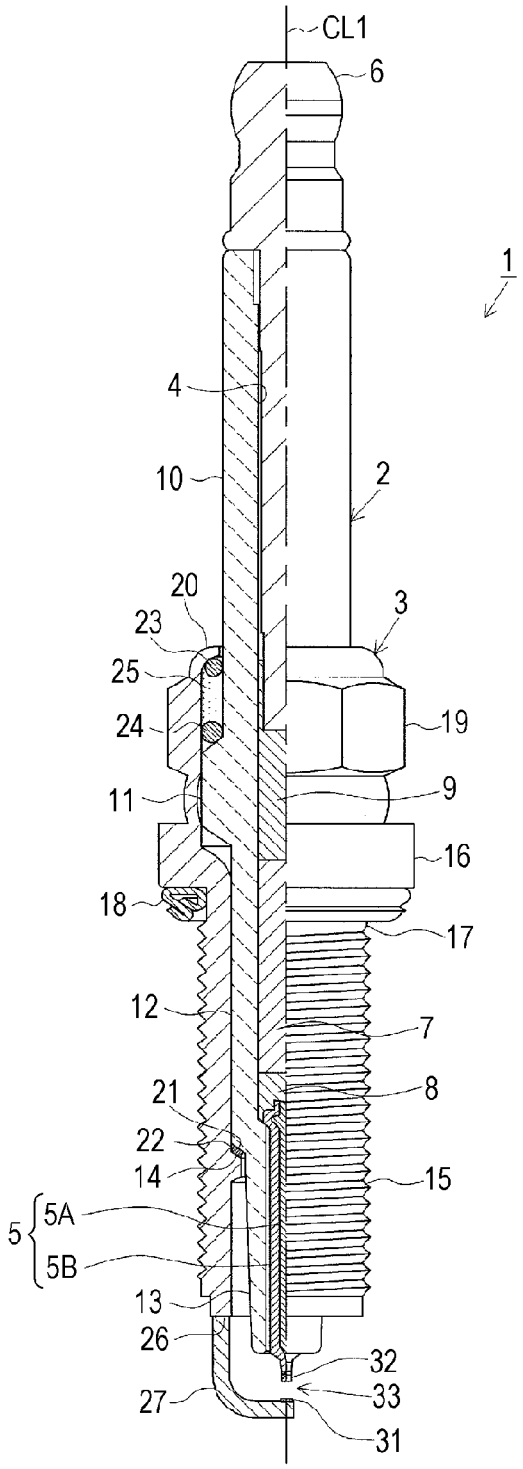
FIG. 1 is a partial sectional front view of a configuration of a spark plug.

FIG. 1 is a partial sectional front view of a spark plug 1. In FIG. 1, the direction of an axial line CL1 of the spark plug 1 corresponds to the top-bottom direction in the drawing, with the bottom and top corresponding to the tip side and the rear end side of the spark plug 1, respectively.

The spark plug 1 includes such as a cylindrical ceramic insulator 2, and a cylindrical metal shell 3 holding the ceramic insulator 2.

The ceramic insulator 2 is formed by sintering alumina and the like in a well-known manner, and includes, in terms of its outer shape, a rear end-side body portion 10 formed on the rear end side, an large-diameter portion 11 located closer to the tip side than the rear end-side body portion 10 and projecting radially outwardly, a middle body portion 12 located closer to the tip side than the large-diameter portion 11 with a smaller diameter than the diameter of the large-diameter portion 11, and an insulator nose portion 13 located closer to the tip side than the middle body portion 12 with a smaller diameter than the diameter of the middle body portion 12. The large-diameter portion 11, the middle body portion 12, and most of the insulator nose portion 13 of the ceramic insulator 2 are housed inside the metal shell 3. The middle body portion 12 and the insulator nose portion 13 are connected via a tapered step portion 14, and the ceramic insulator 2 is locked on the metal shell 3 at the step portion 14.

The ceramic insulator 2 includes an axial hole 4 penetrating the ceramic insulator 2 along the axial line CL1. In the axial hole 4 on the tip side, a center electrode 5 is inserted and fixed. The center electrode 5 includes an inner layer 5A made of a metal with high thermal conductivity [such as copper, a copper alloy, and pure nickel (Ni)], and an outer layer 5B made of an alloy with Ni as a main component. The center electrode 5 is generally bar-like (column), with the tip end projecting from the tip of the ceramic insulator 2.

In the axial hole 4 on the rear end side, a terminal electrode 6 is inserted and fixed, projecting from the rear end of the ceramic insulator 2.

Between the center electrode 5 of the axial hole 4 and the terminal electrode 6, a column resistor element 7 is disposed. The ends of the resistor element 7 are electrically connected to the center electrode 5 and the terminal electrode 6, respectively, via electrically conductive glass seal layers 8 and 9, respectively.

The metal shell 3 is formed in a cylindrical shape from a metal, such as low-carbon steel, with a thread portion (terminal stud portion) 15 formed on an outer circumference surface thereof for installation of the spark plug 1 in an installation opening of a combustion device (such as an internal combustion engine, a fuel cell reformer and the like). On an outer circumference surface closer to the rear end side than the thread portion 15, a radially outwardly projecting seating portion 16 is formed, with a ring-shaped gasket 18 fitted on a thread root 17 at the rear end of the thread portion 15. The metal shell 3 further includes a tool engaging portion 19 disposed on the rear end side, with a hexagonal cross section for engaging a tool, such as a wrench, for installing the metal shell 3 on the combustion device. On a rear-end portion, a crimping portion 20 for holding the ceramic insulator 2 is disposed.

On an inner circumference surface of the metal shell 3, a tapered step portion 21 for locking the ceramic insulator 2 is disposed. The ceramic insulator 2 is inserted into the metal shell 3 from the rear end side toward the tip side, and is fixed by crimping the rear end side opening of the metal shell 3 radially inwardly, i.e., by forming the crimping portion 20, with the step portion 14 locked on the step portion 21 of the metal shell 3. Between the step portions 14 and 21, an annular plate packing 22 is interposed so as to maintain airtightness in the combustion chamber and prevent outside leakage of fuel gas that enters the gap between the insulator nose portion 13 of the ceramic insulator 2 exposed into the combustion chamber and the inner circumference surface of the metal shell 3.

In order to make the crimping seal more complete, annular ring members 23 and 24 are interposed between the metal shell 3 and the ceramic insulator 2 on the rear end side of the metal shell 3, with the gap between the ring members 23 and 24 filled with the powder of talc 25. Thus, the metal shell 3 holds the ceramic insulator 2 via the plate packing 22, the ring members 23 and 24, and the talc 25.

Figure 2:
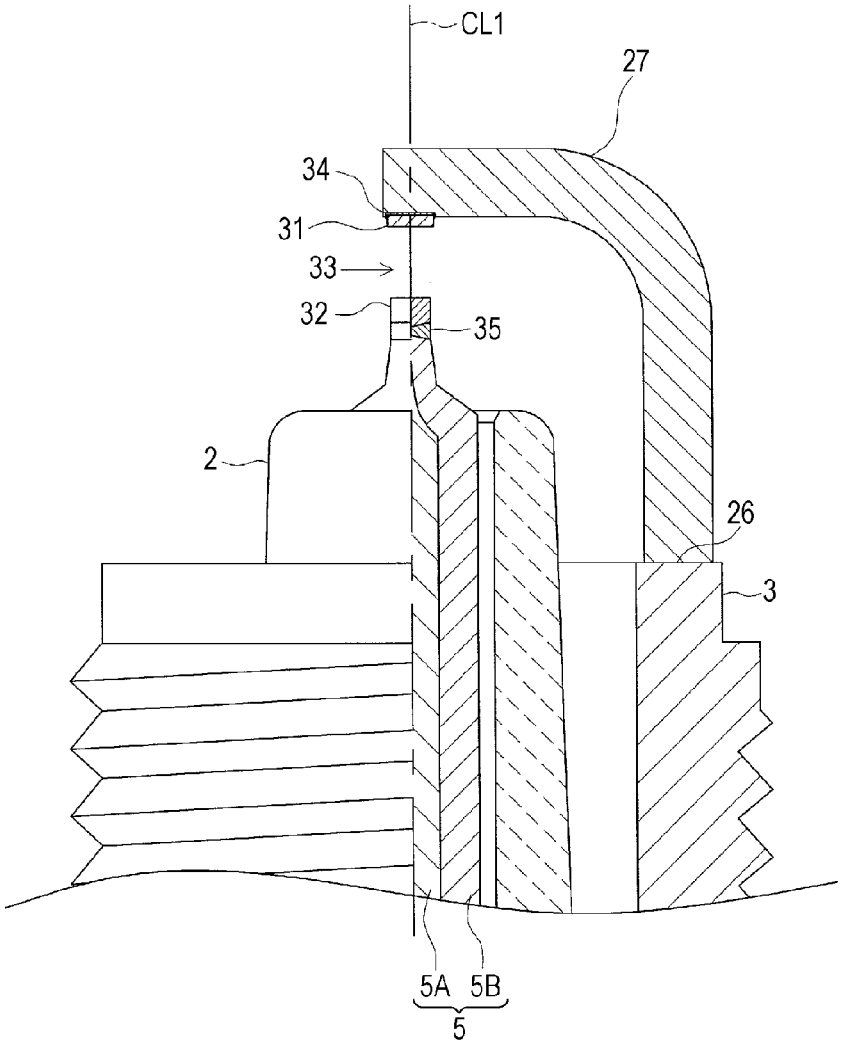
FIG. 2 is an enlarged partial sectional front view of a configuration of a tip end of the spark plug.

As illustrated in FIG. 2, to a tip end 26 of the metal shell 3, a bar-like ground electrode 27 of an alloy with Ni as a main component is joined. The ground electrode 27 is bent at an intermediate portion thereof, with a side of the tip end facing the tip end of the center electrode 5. Between the tip end of the center electrode 5 and the tip end of the ground electrode 27, a spark discharge gap 33 is formed. Spark discharge is performed in the spark discharge gap 33 in a direction along the axial line CL1.

In addition, to a part of the ground electrode 27 that forms the spark discharge gap 33 with the center electrode 5, a column ground electrode-side chip (corresponding to a "chip" according to the present invention) 31 of a metal with a predetermined noble metal [such as iridium (Ir), platinum (Pt), rhodium (Rh), ruthenium (Ru), and palladium (Pd)] as a main component is joined by resistance welding. To a part of the center electrode 5 that forms the spark discharge gap 33 with the ground electrode 27, a column center electrode-side chip (corresponding to a "chip" according to the present invention) 32 of a metal with a predetermined noble metal (such as Ir, Pt, Rh, Ru, and Pd) as a main component is joined by laser welding.

According to the present embodiment, the ground electrode 27 and the center electrode 5 (particularly the outer layer 5B) to which the chips 31 and 32 are welded are formed from an alloy with Ni as the main component, as described above. Thus, the thermal expansion coefficient of the ground electrode-side chip 31 is smaller than the thermal expansion coefficient of the ground electrode 27 to which the ground electrode-side chip 31 is welded. The thermal expansion coefficient of the center electrode-side chip 32 is smaller than the thermal expansion coefficient of the center electrode 5 (outer layer 5B) to which the center electrode-side chip 32 is welded.

In addition, according to the present embodiment, when the content by percentage of the noble metal component of the ground electrode-side chip 31 is A1 (mass %), and when the content by percentage of the noble metal component of the ground electrode 27 is B1 (mass %), A1−B1 is 50 mass % or more. Further, when the content by percentage of the noble metal component of the center electrode-side chip 32 is A2 (mass %) and when the content by percentage of the noble metal component of the center electrode 5 (outer layer 5B) is B2 (mass %), A2−B2 is 50 mass % or more.

Further, according to the present embodiment, the ground electrode 27 and the center electrode 5 (outer layer 5B) contain 10 mass % or more and 35 mass % or less of chrome in order to provide high oxidation resistance while ensuring good workability. In order to further improve oxidation resistance, the ground electrode 27 and the center electrode 5 (outer layer 5B) may contain a predetermined amount (such as 1 mass % or more and 3 mass % or less in total content) of aluminum (Al) and silicon (Si). Further, in order to further improve oxidation resistance and the like, the ground electrode 27 or the center electrode 5 (outer layer 5B) may contain a predetermined amount (such as 0.01 mass % or more and 1 mass % or less in total content) of yttrium (Y), or a rare-earth element [lanthanum (La), cerium (Ce), neodymium (Nd), samarium (Sm), dysprosium (Dy), erbium (Er), and ytterbium (Yb)].

Figure 3:
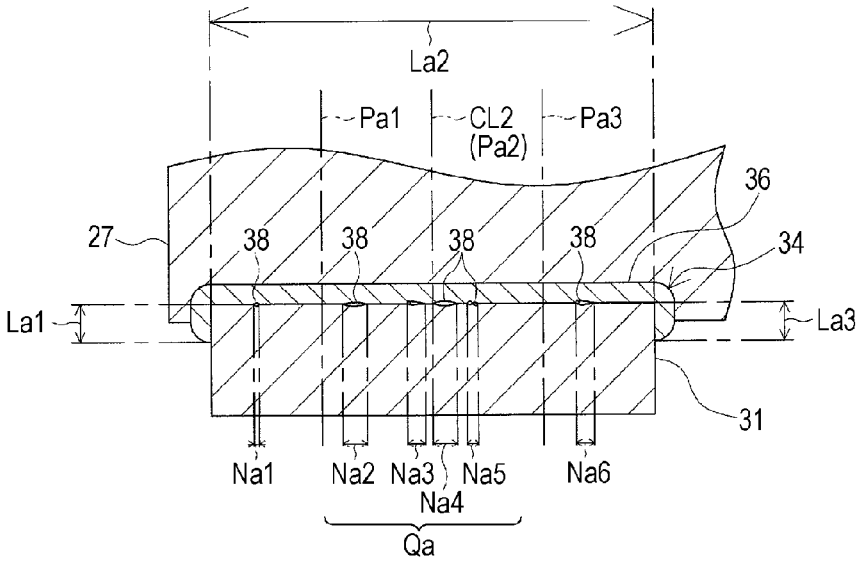
FIG. 3 is an enlarged cross sectional view of a configuration of an intermediate layer positioned between a ground electrode-side chip and a ground electrode.

Between the ground electrode-side chip 31 and the ground electrode 27, an intermediate layer 34 is formed. The intermediate layer 34, as illustrated in FIG. 3, includes a fused portion 36 formed by the fusing of the ground electrode-side chip 31 and the ground electrode 27, and a plurality of holes 38 formed in a boundary portion of the fused portion 36 and the ground electrode-side chip 31 (It should be noted that in FIG. 3, the fused portion 36 and the holes 38 are illustrated thicker than they really are for illustrative purposes. Also, the holes 38 are illustrated larger than they really are, and in smaller numbers. The fused portion 36 may be very thin and may even be unidentifiable when, for example, the ground electrode-side chip 31 is joined to the ground electrode 27 by resistance welding). By the fused portion 36, the ground electrode-side chip 31 is joined to the ground electrode 27. According to the present embodiment, the fused portion 36 is formed over the entire area between the ground electrode-side chip 31 and the ground electrode 27.

In addition, when the length of the boundary of the ground electrode-side chip 31 and the intermediate layer 34 in a cross section including a central axis CL2 of the ground electrode-side chip 31 is La [=La1+La2+La3 (mm)], and the length of the holes 38 in a direction along the boundary is Na [=Na1+Na2+Na3+Na4+Na5+Na6 (mm)], $0.1 \leq Na/La \leq 0.4$ is satisfied.

Further, in a cross section including the central axis CL2, the range of the ground electrode-side chip 31 from one side to the other side is equally divided into 4 parts by a straight line Pa1, a straight line Pa2 (which corresponds to the central axis CL2 according to the present embodiment), and a straight line Pa3 in order from one end which are parallel with the central axis CL2. In this case, when the length of the holes 38 in the direction along the boundary between the ground electrode-side chip 31 and the intermediate layer 34 in the range from the straight line Pa1 to the straight line Pa3 is Qa [=Na2+Na3+Na4+Na5 (mm)], $0.6 \leq Qa/Na$ is satisfied. Namely, most of the holes 38 are positioned toward the center of the ground electrode-side chip 31.

Further, as illustrated in FIG. 2, between the center electrode-side chip 32 and the center electrode 5 (outer layer 5B), an intermediate layer 35 is formed.

Figure 4:
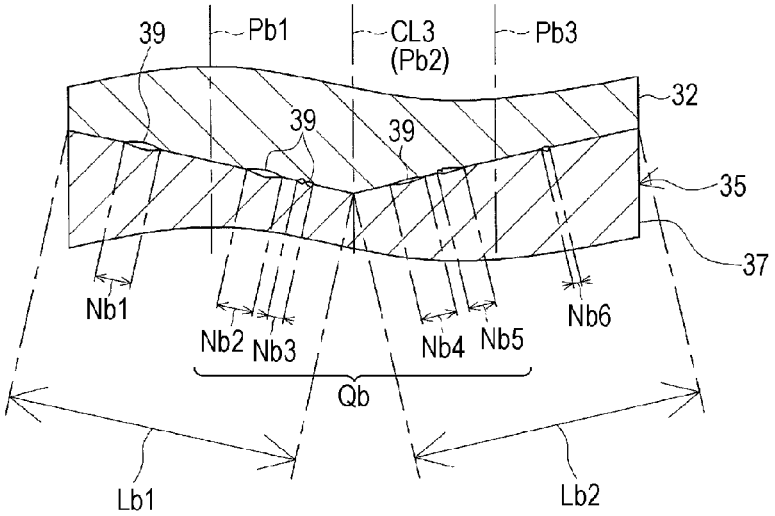
FIG. 4 is an enlarged cross sectional view of a configuration of the intermediate layer positioned between a center electrode-side chip and a center electrode.

The intermediate layer 35, as illustrated in FIG. 4, includes a fused portion 37 formed by the fusion of the center electrode-side chip 32 and the center electrode 5 (outer layer 5B), and a plurality of holes 39 formed in a boundary portion of the fused portion 37 and the center electrode-side chip 32 (in FIG. 4, the holes 39 are illustrated thicker and longer than they really are, and in numbers smaller than the actual number for illustrative purposes).

By the fused portion 37, the center electrode-side chip 32 is joined to the center electrode 5 (outer layer 5B). According to the present embodiment, the fused portion 37 is formed over the entire area between the center electrode-side chip 32 and the center electrode 5.

In a cross section including a central axis CL3 of the center electrode-side chip 32, when the length of a boundary between the center electrode-side chip 32 and the intermediate layer 35 is Lb [=Lb1+Lb2 (mm)] and the length of the holes 39 in a direction along the boundary is Nb [=Nb1+Nb2+Nb3+Nb4+Nb5+Nb6 (mm)], $0.1 \leq Nb/Lb \leq 0.4$ is satisfied.

In the cross section including the central axis CL3, the range of the center electrode-side chip 32 from one side to the other side is equally divided into 4 parts by a straight line Pb1, a straight line Pb2 (which corresponds to the central axis CL3 according to the present embodiment), and a straight line Pb3 in order from one end which are parallel with the central axis CL3. In this case, when the length of holes 39 in a direction along the boundary between the center electrode-side chip 32 and the intermediate layer 35 in the range from the straight line Pb1 to the straight line Pb3 is Qb [=Nb2+Nb3+Nb4+Nb5 (mm)], $0.6 \leq Qb/Nb$ is satisfied. Namely, most of the holes 39 are positioned toward the center of the center electrode-side chip 32.

The lengths of the holes 38 and 39 along the boundaries can be adjusted as follows. When the chips 31 and 32 are welded by resistance welding, the lengths of the holes 38 and 39 can be adjusted by varying the pressing load of the chips 31 and 32 with respect to the electrodes 5 and 27 or flowing current during the resistance welding. For example, by increasing the pressing load and thereby increasing the area of contact between the chips 31 and 32 and the electrodes 5 and 27, the amount of heat generated during resistance welding can be decreased, whereby the number of the holes 38 and 39 formed can be increased (the lengths of the holes 38 and 39 can be increased). When the chips 31 and 32 are welded by laser welding, by varying the pressing load of the chips 31 and 32 with respect to the electrodes 5 and 27 or the laser beam energy during laser welding, the length of the holes 38 and 39 can be adjusted. For example, by increasing the laser beam energy, the amount of heat generated can be increased, whereby a relatively small number of the holes 38 and 39 can be formed (the length of the holes 38 and 39 can be decreased). It is also possible to adjust the lengths of the holes 38 and 39 by adjusting the amount of gas contained in the chips 31 and 32 or the electrodes 5 and 27, for example, rather than by varying the welding conditions.

The lengths of the holes 38 and 39 can be measured by the following method. The cross section including the central axis CL2 or CL3 is obtained and then polished by cross polishing or ion beam irradiation using a focused ion beam (FIB) device. Thereafter, the polished cross section is observed by a scanning electron microscope (SEM) and the like to measure the lengths of the holes 38 and 39.

Figure 5:
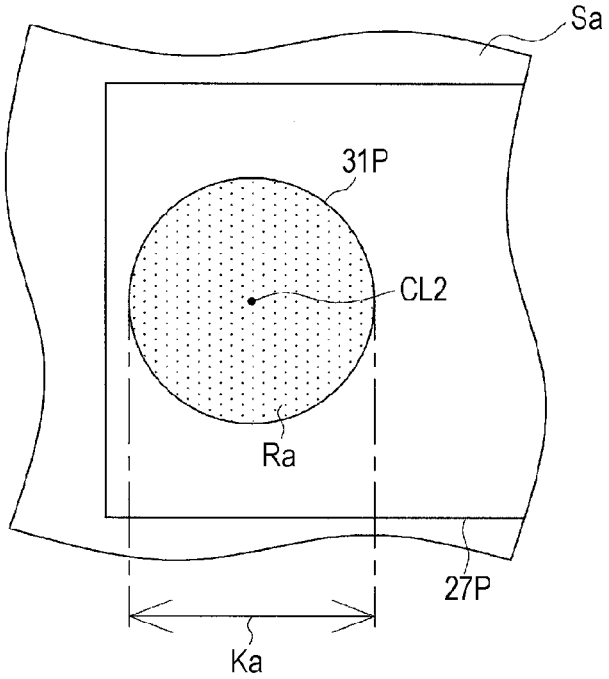
FIG. 5 is a projection view of the ground electrode-side chip and the like for explaining a length Ka.
Figure 6:
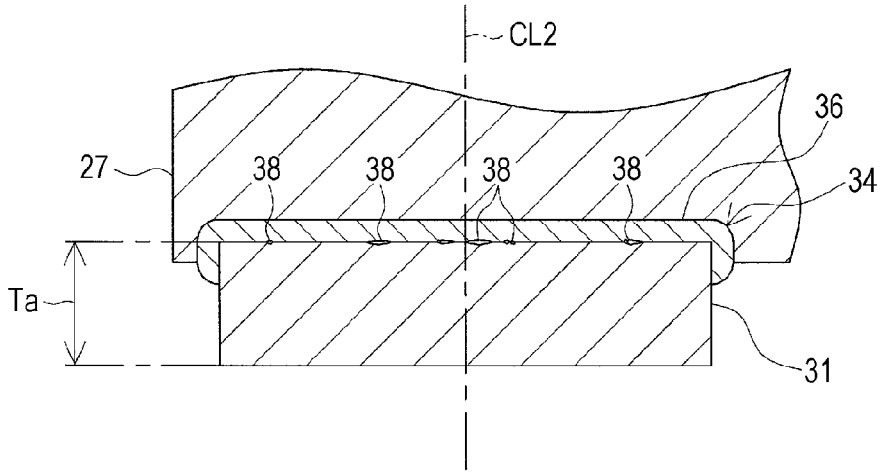
FIG. 6 is an enlarged cross sectional view of a maximum thickness Ta of the ground electrode-side chip.

In addition, according to the present embodiment, as illustrated in FIG. 5, when, in a plane Sa perpendicular to the central axis CL2 of the ground electrode-side chip 31, the ground electrode 27 and the end face of the ground electrode-side chip 31 positioned on the ground electrode 27 side are projected, an area Ra (the part with dotted pattern in FIG. 5) in which a projection plane 27P of the ground electrode 27 and a projection plane 31P of the end face are overlapped is circular. When the diameter of the area Ra is Ka (mm), and the maximum thickness of the ground electrode-side chip 31 along the central axis CL2 is Ta (mm) as illustrated in FIG. 6, $Ka/Ta \geq 1.2$ is satisfied. Namely, Ka is set relatively large for increasing the discharge area (increasing wear resistance), while Ta is set relatively small from the viewpoint of manufacturing cost and the like. Thus, the ground electrode-side chip 31 is relatively thin.

Figure 7:
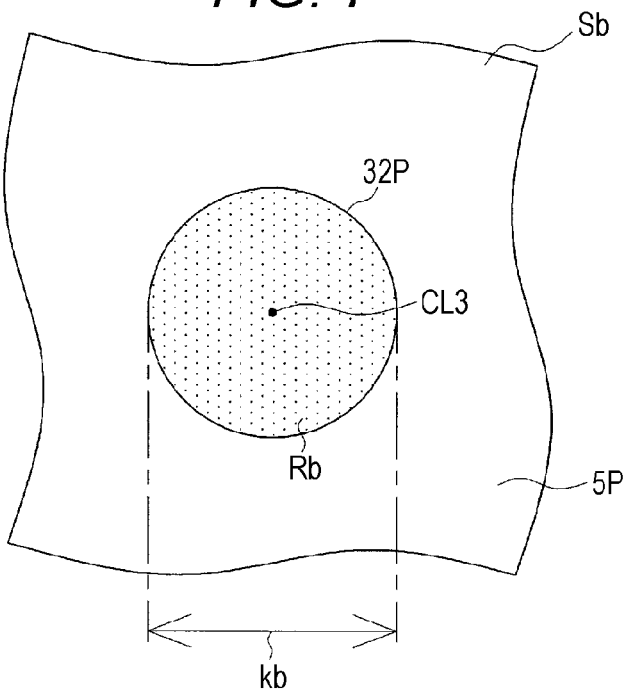
FIG. 7 is a projection view of the center electrode-side chip and the like for explaining a length Kb.
Figure 8:
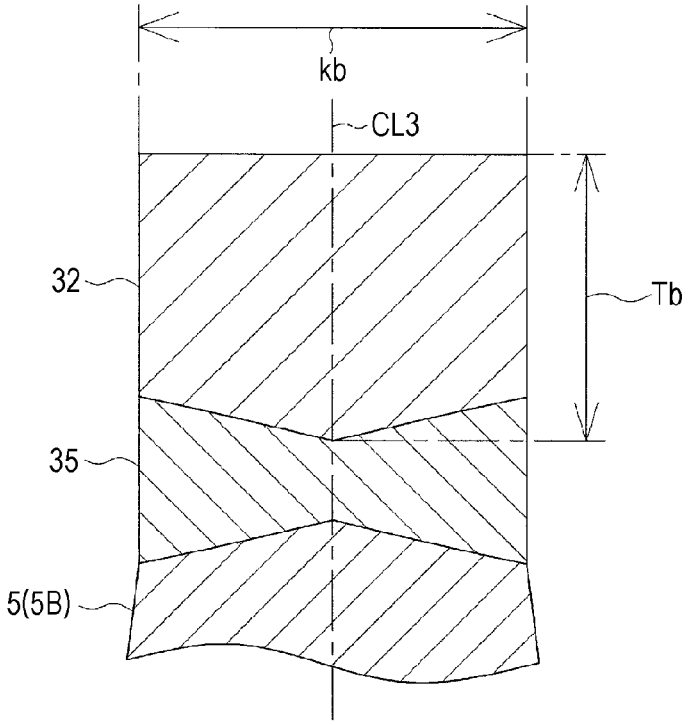
FIG. 8 is an enlarged cross sectional view of a maximum thickness Tb of the center electrode-side chip.

According to the present embodiment, as illustrated in FIG. 7, when, in a plane Sb perpendicular to the central axis CL3 of the center electrode-side chip 32, the center electrode 5 and the end face of the center electrode-side chip 32 positioned on the center electrode 5 side are projected, an area Rb (the part with dotted pattern in FIG. 7) in which a projection plane 5P of the center electrode 5 and a projection plane 32P of the end face are overlapped is circular. When the diameter of the area Rb is Kb (mm), and the maximum thickness of the center electrode-side chip 32 along the central axis CL3 as illustrated in FIG. 8 (in FIG. 8, the holes 39 are not illustrated) is Tb (mm), $Kb/Tb \geq 1.2$ is satisfied. Namely, as in the ground electrode-side chip 31, the center electrode-side chip 32 is also relatively thin.

As described above, according to the present embodiment, A1−B1 (A2−B2) is 50 mass % or more, whereby the noble metal component contained in the chips 31 and 32 can be sufficiently diffused during use (at high temperature). As a result of the diffusion, the holes 38 and 39 present in the intermediate layers 34 and 35 can be caused to enter the chips 31 and 32 (particularly on the intermediate layers 34 and 35 side), whereby holes can be formed inside the chips 31 and 32. By these holes formed inside the chips 31 and 32, the stress applied to the chips 31 and 32 from the electrodes 5 and 27 as the electrodes 5 and 27 are thermally expanded can be reduced. Accordingly, the thermal expansion difference between the part of the chips 31 and 32 on the electrodes 5 and 27 side and the part of the chips 31 and 32 on the opposite side from the electrodes 5 and 27 can be decreased. As a result, the development of deformation or breakage in the chips 31 and 32 can be more reliably prevented.

Further, because of the presence of the holes formed inside the chips 31 and 32, the difference in thermal stress between the electrodes 5 and 27 and the chips 31 and 32 can be decreased. Thus, the formation of oxide scales between the chips 31 and 32 and the electrodes 5 and 27 can be effectively suppressed, whereby the weldability of the chips 31 and 32 with respect to the electrodes 5 and 27 can be increased. As a result, the peeling (detachment) of the chips 31 and 32 can be more reliably prevented.

Further, according to the present embodiment, $0.6 \leq Qa/Na$ and $0.6 \leq Qb/Nb$, so that most of the holes 38 and 39 are formed toward the center of the chips 31 and 32 where the difference in thermal stress between the chips 31 and 32 and the electrodes 5 and 27 tends to be increased. Thus, the number of holes formed in the chips 31 and 32 can be increased toward the center during use (at high temperature), whereby the differences in thermal stress between the electrodes 5 and 27 and the chips 31 and 32 can be more effectively decreased. As a result, the weldability of the chips 31 and 32 can be further increased, so that the peeling (detachment) of the chips 31 and 32 can be more reliably prevented.

In addition, because $Ka/Ta \geq 1.2$ and $Kb/Tb \geq 1.2$ are satisfied, the difference in thermal stress between the electrodes 5 and 27 and the chips 31 and 32 can be further decreased, whereby the weldability can be further improved.

When $Ka/Ta \geq 1.2$ and $Kb/Tb \geq 1.2$ are satisfied, the concern about deformation or breakage of the chips 31 and 32 may be increased. However, when the above configuration is satisfied, the deformation and the like of the chips 31 and 32 can be more reliably prevented. As a result, the demerit (decrease in deformation resistance) arising from satisfying Ka/Ta≥1.2 (Kb/Tb≥1.2) can be eliminated while the merit (excellent weldability) obtained by satisfying Ka/Ta≥1.2 (Kb/Tb≥1.2) is sufficiently maintained.

When the electrodes 5 and 27 contain Y or a rare-earth element, strain can be produced in the crystal lattice of the electrodes 5 and 27 because such elements have a relatively large atomic radius. As a result, the diffusion of the noble metal component contained in the chips 31 and 32 is facilitated, and the holes can be more reliably caused to enter the chips 31 and 32. As a result, the above-described operational effect can be more reliably achieved.

Second Embodiment

Figure 9:
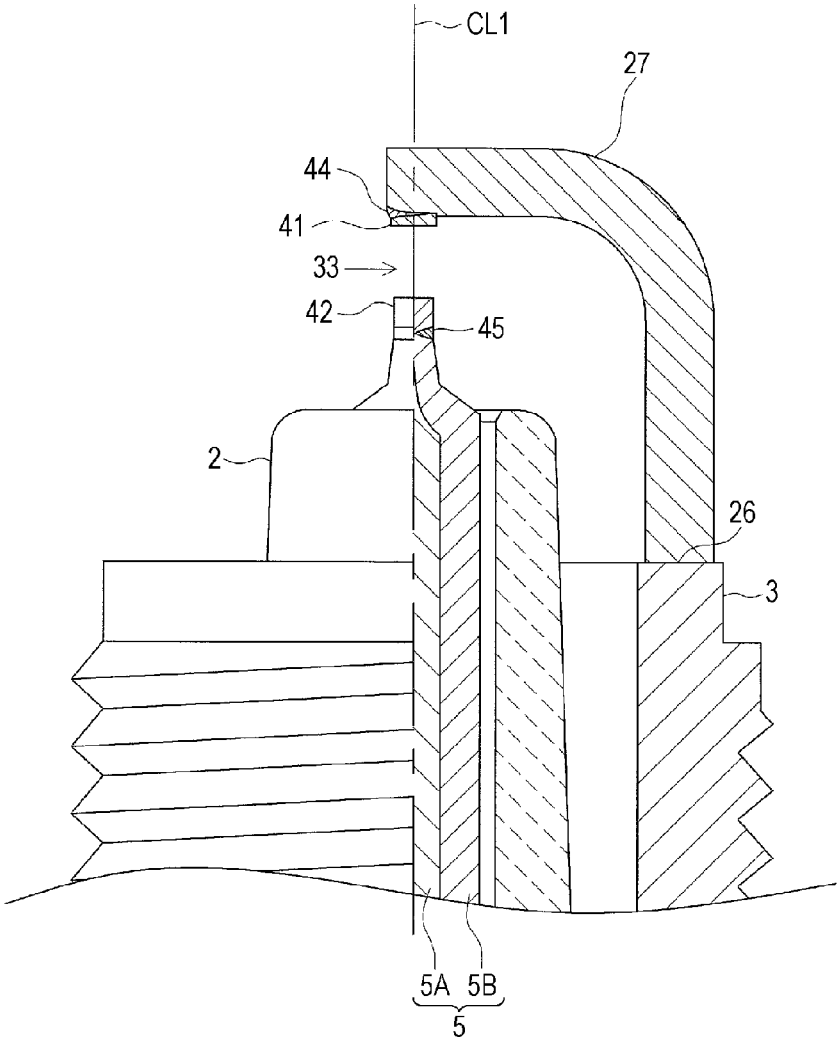
FIG. 9 is an enlarged partial sectional front view of a configuration of the tip end of the spark plug according to a second embodiment.
Figure 10:
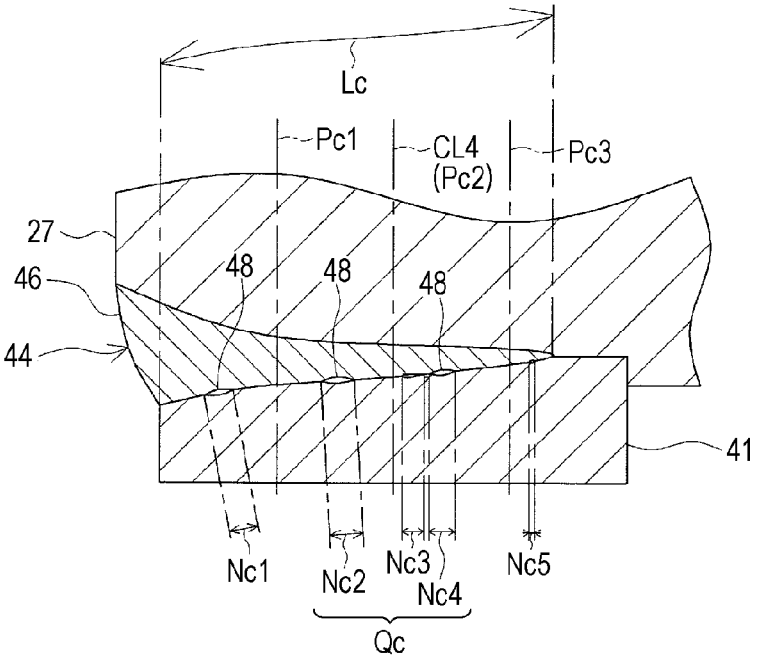
FIG. 10 is an enlarged cross sectional view of a configuration of the intermediate layer disposed between the ground electrode-side chip and the ground electrode.

In the following, a second embodiment will be described while focusing on differences from the first embodiment. According to the first embodiment, the intermediate layer 34 is formed over the entire area between the ground electrode-side chip 31 and the ground electrode 27, and the intermediate layer 35 is formed over the entire area between the center electrode-side chip 32 and the center electrode 5 (outer layer 5B). In contrast, according to the second embodiment, by varying the weld conditions, an intermediate layer 44 is formed in a part of the area between the ground electrode-side chip 41 and the ground electrode 27, as illustrated in FIG. 9, and an intermediate layer 45 is formed in a part of the area between the center electrode-side chip 42 and the center electrode 5 (outer layer 5B). According to the present embodiment, as illustrated in FIG. 10, in order to ensure sufficient weldability of the ground electrode-side chip 41 with respect to the ground electrode 27, in a cross section including a central axis CL4 of the ground electrode-side chip 41, the length of the boundary of the ground electrode-side chip 41 and the intermediate layer 44 is made greater than the length of the part of the ground electrode-side chip 41 that adjoins the ground electrode 27 without the intermediate layer 44. Further, in order to ensure sufficient weldability of the center electrode-side chip 42 with respect to the center electrode 5, as illustrated in FIG. 11, the length of the boundary of the center electrode-side chip 42 and the intermediate layer 45 is made greater than the length of the part of the center electrode-side chip 42 that adjoins the center electrode 5 without the intermediate layer 45.

In addition, as illustrated in FIG. 10, the intermediate layer 44 includes a fused portion 46 and a plurality of holes 48 positioned at a boundary portion of the fused portion 46 and the ground electrode-side chip 41. In a cross section including the central axis CL4 of the ground electrode-side chip 41, when the length of the boundary of the ground electrode-side chip 41 and the intermediate layer 44 is Lc (mm), and the length of the holes 48 in a direction along the boundary is Nc [=Nc1+Nc2+Nc3+Nc4+Nc5 (mm)], 0.1≥Nc/Lc≥0.4 is satisfied. When the ground electrode-side chip 41 is joined to the ground electrode 27 by resistance welding, for example, the fused portion 46 may be very thin and may even be hardly recognizable.

Further, in the cross section including the central axis CL4, the range of the ground electrode-side chip 41 from one side to the other side is equally divided into 4 parts by a straight line Pc1, a straight line Pc2 (which corresponds to the central axis CL4 according to the present embodiment), and a straight line Pc3 in order from one end which are parallel with the central axis CL4. In this case, when the length of the holes 48 in a direction along the boundary in the range from the straight line Pc1 to the straight line Pc3 is Qc [=Nc2+Nc3+Nc4 (mm)], 0.6≤Qc/Nc is satisfied.

Figure 11:
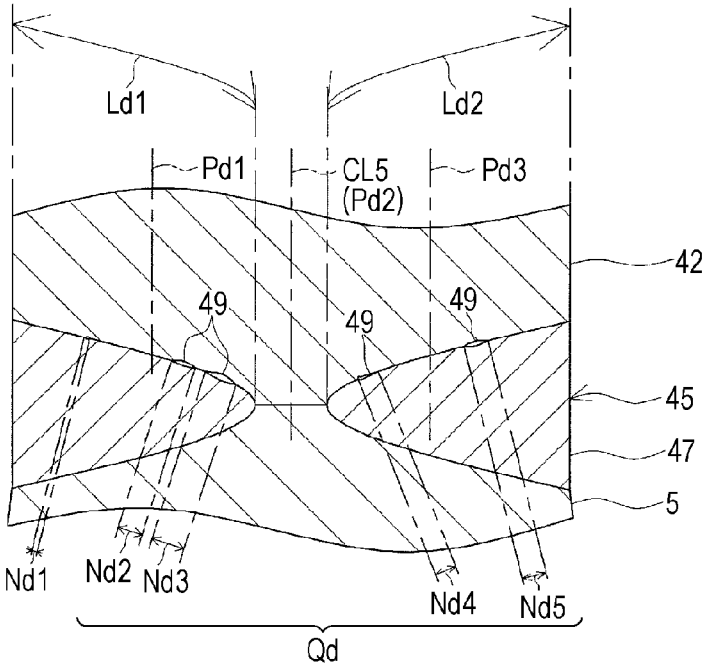
FIG. 11 is an enlarged cross sectional view of a configuration of the intermediate layer positioned between the center electrode-side chip and the center electrode.

As illustrated in FIG. 11, the intermediate layer 45 includes a fused portion 47 and a plurality of holes 49 positioned at a boundary portion of the fused portion 47 and the center electrode-side chip 42. In a cross section including a central axis CL5 of the center electrode-side chip 42, when the length of the boundary of the center electrode-side chip 42 and the intermediate layer 45 is Ld [=Ld1+Ld2 (mm)], and the length of the holes 49 in a direction along the boundary is Nd [=Nd1+Nd2+Nd3+Nd4+Nd5 (mm)], 0.1≤Nd/Ld≤0.4 is satisfied.

In addition, in the cross section including the central axis CL5, the range of the center electrode-side chip 42 from one side to the other side is equally divided into 4 parts by a straight line Pd1, a straight line Pd2 (which corresponds to the central axis CL5 according to the present embodiment), and a straight line Pd3 in order from one end which are parallel with the central axis CL5. In this case, when the length of the holes 49 in a direction along the boundary in the range from the straight line Pd1 to the straight line Pd3 is Qd [=Nd2+Nd3+Nd4+Nd5 (mm)], 0.6≤Qd/Nd is satisfied.

According to the first embodiment, the ground electrode-side chip 31 is column. However, according to the second embodiment, the ground electrode-side chip 41 is cuboidal.

Figure 12:
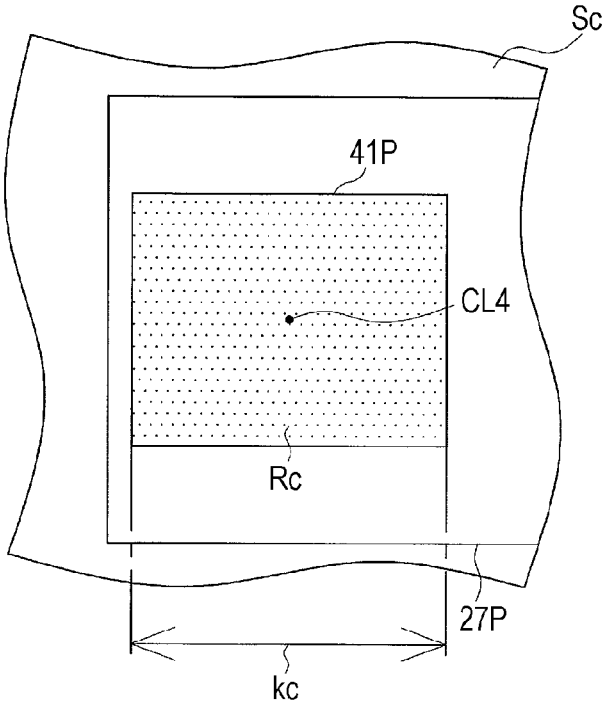
FIG. 12 is a projection view of the ground electrode-side chip and the like for explaining a length Kc.

Thus, as illustrated in FIG. 12, when, in a plane Sc perpendicular to the central axis CL4 of the ground electrode-side chip 41, the ground electrode 27 and an end face of the ground electrode-side chip 41 on the ground electrode 27 side are projected along the central axis CL4, an area Rc in which a projection plane 27P of the ground electrode 27 and a projection plane 41P of the end face are overlapped is rectangular.

Figure 13:
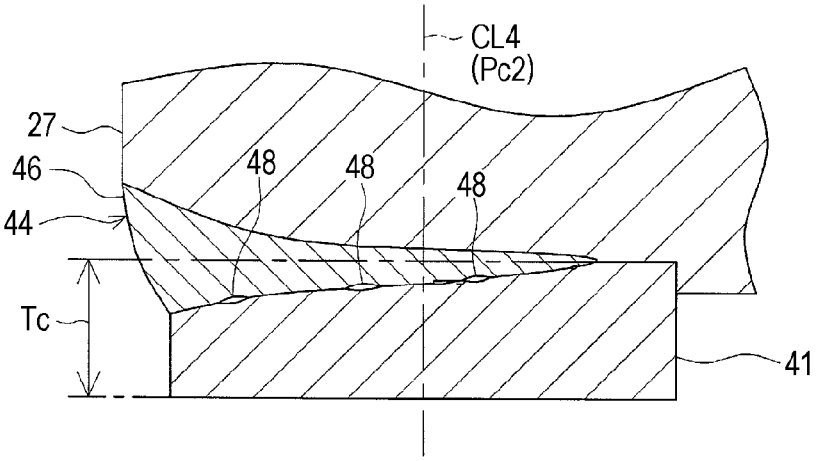
FIG. 13 is an enlarged cross sectional view of the ground electrode-side chip having the maximum thickness Tc.

Further, when the long sides of the area Rc are Kc (mm), and the maximum thickness of the ground electrode-side chip 41 along the central axis CL4 is Tc (mm), as illustrated in FIG. 13, Kc/Tc≥1.2 is satisfied.

Thus, according to the second embodiment, an operational effect similar to the one according to the first embodiment can be obtained. Namely, deformation or breakage of the chips 41 and 42 can be highly effectively prevented while the weldability of the chips 41 and 42 with respect to the electrodes 5 and 27 is greatly increased.

Third Embodiment

Figure 14:
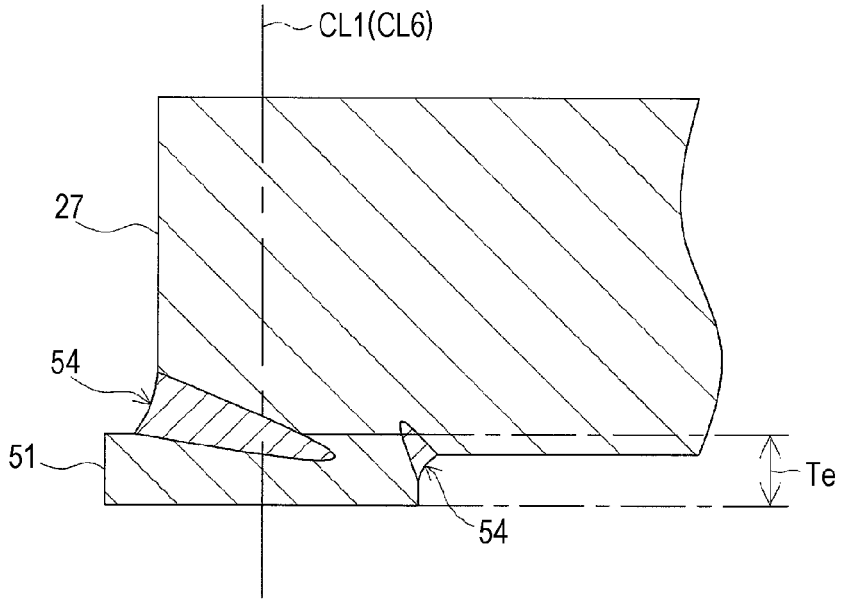
FIG. 14 is an enlarged cross sectional view of a relative positional relationship and the like of the ground electrode-side chip and the ground electrode according to a third embodiment.

A third embodiment will be described while focusing on differences from the first and the second embodiments. In the first and the second embodiments, the ground electrode-side chips 31 and 41 are entirely positioned on the proximal side with respect to the tip of the ground electrode 27. In contrast, according to the third embodiment, as illustrated in FIG. 14, a ground electrode-side chip 51 is welded to the ground electrode 27 with a part of the ground electrode-side chip 51 projecting beyond the tip of the ground electrode 27. In order to ensure sufficient weldability of the ground electrode-side chip 51 with respect to the ground electrode 27, the length of the boundary of the ground electrode-side chip 51 and the intermediate layer 54 is made greater than the length of a part of the ground electrode-side chip 51 that adjoins the ground electrode 27 without the intermediate layer 54.

Figure 15:
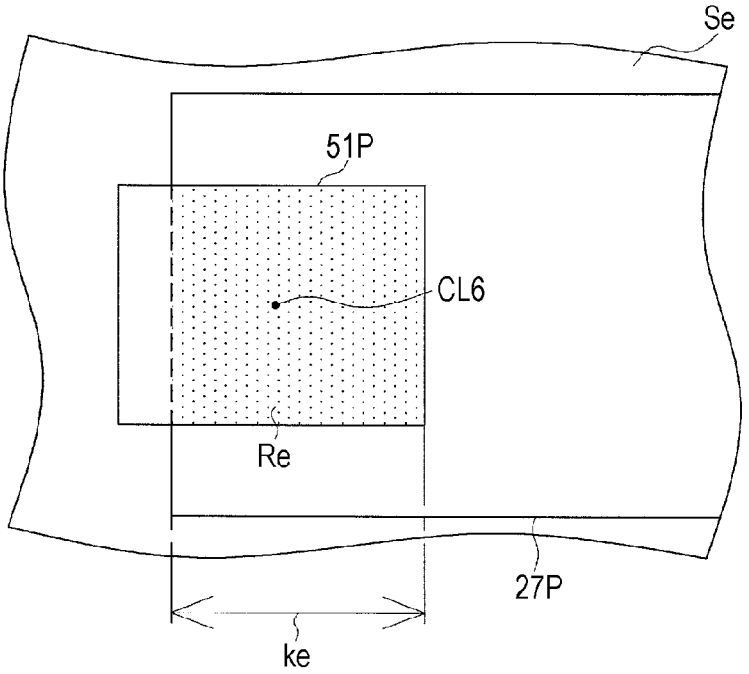
FIG. 15 is a projection view of the ground electrode-side chip and the like for explaining a length Ke.

In addition, the ground electrode-side chip 51 is cuboidal as in the second embodiment. Thus, as illustrated in FIG. 15, when, in a plane Se perpendicular to a central axis CL6 of the ground electrode-side chip 51, the ground electrode 27 and an end face of the ground electrode-side chip 51 positioned on the ground electrode 27 side (the part of the outer surface of the ground electrode-side chip 51 that adjoins the intermediate layer 54 with the widest range and that is particularly important in ensuring weldability) are projected along the central axis CL6, an area Re in which a projection plane 27P of the ground electrode 27 and a projection plane 51P of the end face are overlapped is rectangular. When the long sides of the area Re are Ke (mm), and the maximum thickness of the ground electrode-side chip 51 along the central axis CL6 is Te (mm), as illustrated in FIG. 14, Ke/Te≥1.2 is satisfied.

Thus, according to the third embodiment, basically the same operational effect as according to the first and the second embodiments can be obtained.

In addition, because the ground electrode-side chip 51 projects beyond the tip of the ground electrode 27, the inhibition of growth of flame kernel by the ground electrode 27 can be suppressed. As a result, ignitability can be improved.

In order to confirm the operational effects of the embodiments, a plurality of spark plug samples including chips with different compositions in which the difference between the content A (mass %) of the noble metal component of the chip and the content B (mass %) of the noble metal component in the ground electrode to which the chip is welded (A−B) was varied were prepared. In each of the samples, by adjusting the pressing load, flowing current, and the like during welding, the ratio of the length N (mm) of the holes in the direction along the boundary to the length L (mm) of the boundary of the chip and the intermediate layer (N/L), and the ratio of the length Q (mm) of the holes positioned toward the center of the chips (positioned in the area from the straight line P1 to the straight line P3) in the direction along the boundary to the length N (Q/N) were varied. Each of the samples was subjected to a desktop burner test. Specifically, under atmospheric conditions, a cycle of heating by a burner for two minutes so that the temperature of the ground electrode was 1000° C., followed by slow cooling for one minute was repeated 1000 times. At the end of the 1000 cycles, the chip surface (the face on the opposite side from the intermediate layer that forms the spark discharge gap), and a cross section of the ground electrode were observed to evaluate each sample in terms of deformation resistance and weldability.

Specifically, those samples with deformation or breakage on the chip surface were evaluated to be "Poor" as being inferior in deformation resistance, while those samples without deformation or breakage on the chip surface were evaluated to be "Good" as having good deformation resistance.

The length of oxide scales formed at the boundary portion with respect to the length of the boundary portion of the chip and the intermediate layer was measured, and the ratio of the length of the oxide scales with respect to the length of the boundary portion (oxide scale ratio) was calculated. The samples with the oxide scale ratio of 50% or more were evaluated to be "Poor" as being inferior in weldability. On the other hand, the samples with the oxide scale ratio of 25% or more and 50% or less were evaluated to be "Good" as having good weldability, and the samples with the oxide scale ratio of less than 25% were evaluated to be "double-Good" as having excellent weldability.

The samples were further generally judged in terms of deformation resistance and weldability. The samples with the "Poor" evaluation in at least one of deformation resistance and weldability were given the general judgment of "Poor." On the other hand, the samples with the "Good" evaluation in both deformation resistance and weldability were given the general judgment of "Good," while the samples with the "Good" evaluation in deformation resistance and the "Excellent" evaluation in weldability were given the general judgment of "Excellent."

Table 1 shows the results of the test results. In each sample, the ground electrode was formed by INC 600 (registered trademark) (Ni-16Cr-7Fe). The thermal expansion coefficient of the chip was set smaller than the thermal expansion coefficient of the ground electrode.

TABLE 1

| No. | Chip composition | A-B (mass %) | N/L | Q/N | Deformation resistance evaluation | Weldability evaluation | General judgment |
|---|---|---|---|---|---|---|---|
| 1 | Ni-30Pt-10Ir | 30 | 0.2 | 0.5 | Poor | Good | Poor |
| 2 | Ni-45Pt | 45 | 0.2 | 0.9 | Poor | Excellent | Poor |
| 3 | Pt-10Ni | 90 | 0.1 | 0.5 | Poor | Poor | Poor |
| 4 | Pt-10Ni | 90 | 0.5 | 0.5 | Good | Poor | Poor |
| 5 | Pt-10Ni | 90 | 0.1 | 0.6 | Good | Good | Good |
| 6 | Pt-50Ni | 50 | 0.2 | 0.5 | Good | Good | Good |
| 7 | Pt-20Rh-10Ni | 90 | 0.3 | 0.5 | Good | Good | Good |
| 8 | Pt-10Ni | 90 | 0.4 | 0.4 | Good | Good | Good |
| 9 | Pt-20Ni | 80 | 0.2 | 0.6 | Good | Good | Good |
| 10 | Rh-20Ni | 80 | 0.2 | 0.6 | Good | Excellent | Excellent |
| 11 | Pt-20Ni | 80 | 0.2 | 0.7 | Good | Excellent | Excellent |

It is seen from Table 1 that the samples in which A−B was less than 50 mass % (samples 1 and 2) tends to develop deformation or breakage in the chip. This is presumably due to the fact that, because of the small concentration difference between the noble metal components, the noble metal component of the chip is not readily diffused into the ground electrode side at high temperature, so that the holes do not readily enter the chip.

It is seen that the sample in which N/L is less than 0.1 (sample 3) and the sample in which N/L is greater than 0.4 (sample 4) are inferior in deformation resistance or weldability.

On the other hand, it is seen that the samples in which A−B was 50 mass % or more and in which 0.1≤N/L≤0.4 is satisfied (samples 5 to 11) provide good performance in both deformation resistance and weldability. This is presumably due to the following reason. Because A−B is 50 mass % or more, the noble metal component of the chip is sufficiently diffused to the ground electrode side at high temperature. The diffusion causes the holes formed in a relatively large area of the boundary portion to enter the chip (intermediate layer side), forming holes of relatively large volumes in the chip. The holes reduce the stress applied to the chip from the ground electrode as the ground electrode is thermally expanded, whereby the thermal expansion difference between the part of the chip positioned on the ground electrode side and the part of the chip positioned on the surface side is reduced. As a result, the development of deformation or breakage in the chip surface is suppressed. Also, the presence of the holes formed in the chip decreases the difference in thermal stress between the ground electrode and the chip, whereby the formation of oxide scales in the boundary portion is suppressed.

It is also seen that the samples in which 0.6≤Q/N is satisfied (samples 10 and 11) have excellent weldability. This is presumably due to the fact that the large number of holes formed inside at the chip center, where the difference in thermal stress between the chip and the ground electrode tends to become particularly large, more effectively decreases the difference in thermal stress.

From the above test results, it can be said that, in order to obtain high weldability and high deformation resistance, it may be preferable that the difference between the content A (mass %) of the noble metal component of the chip and the content B (mass %) of the noble metal component of the electrode (A−B) is 50 mass % or more and that $0.1 \leq N/L \leq 0.4$ is satisfied.

More preferably, in order to further increase weldability, $0.6 \leq A/N$ may be satisfied.

Next, a plurality of spark plug samples in which column chips with various outer diameters [which is equal to the diameter K (mm) of the area in which the projection plane of the chip and the projection plane of the ground electrode are overlapped] and with various maximum thicknesses T (mm) along the central axis were welded to the ground electrode were prepared. The samples were subjected to the above desktop burner test, and their deformation resistance and weldability were evaluated.

Table 2 shows the test results. In each sample, the chip was formed of Pt-20Ni, the ground electrode was formed of Ni-1.5Si-1.5Cr-2Mn, and the thermal expansion coefficient of the chip was smaller than the thermal expansion coefficient of the ground electrode.

TABLE 2

| No. | K (mm) | T (mm) | K/T | N/L | Deformation resistance evaluation | Weldability evaluation | General judgment |
|---|---|---|---|---|---|---|---|
| 21 | 0.7 | 0.3 | 2.3 | 0.25 | Good | Excellent | Excellent |
| 22 | 0.9 | 0.6 | 1.5 | 0.25 | Good | Excellent | Excellent |
| 23 | 0.85 | 0.7 | 1.2 | 0.25 | Good | Excellent | Excellent |
| 24 | 0.5 | 0.5 | 1.0 | 0.25 | Good | Good | Good |

As illustrated in Table 2, the samples in which $K/T \geq 1.2$ is satisfied (samples 21 to 23) have excellent weldability and good deformation resistance. This is presumably due to the following reason.

In the relatively thin chips with $K/T \geq 1.2$, the part of the chip on the ground electrode side tends to be deformed in conformity with the deformation of the ground electrode when the ground electrode is thermally expanded at high temperature. Thus, the difference in thermal stress between the ground electrode and the chip is decreased, whereby excellent weldability can be obtained.

Meanwhile, because the part of the chip positioned on the ground electrode side is deformed more, the thermal expansion difference between the part of the chip on the ground electrode side and the part of the chip on the surface side (the opposite side from the intermediate layer) is increased. As a result, the chip with $K/T \geq 1.2$ tends to develop deformation or breakage and have inferior deformation resistance.

However, because of the holes provided in the intermediate layer, as described above, the thermal expansion difference between the part of the chip on the ground electrode side and the part of the chip on the surface side (the opposite side from the intermediate layer) can be decreased, whereby the deformation or breakage of the chip can be more reliably prevented. Namely, when the chip with $K/T \geq 1.2$ that tends to have excellent weldability and yet tends to have insufficient deformation resistance is used, the deformation resistance can be sufficiently increased by providing the holes in the intermediate layer as described above. As a result, excellent weldability and good deformation resistance can be obtained.

The description of the foregoing embodiments is not limiting, and the following implementations are also possible. Obviously, other applications or modifications not exemplified below may be possible.

(a) In the above embodiments, the chips 31 and 32 are welded to both the center electrode 5 and the ground electrode 27. However, the chip may be disposed on one of the electrodes. In this case, the spark discharge gap is formed between the chip disposed on one electrode and the other electrode.

(b) In the above embodiments, the chip is formed of a metal with a noble metal as a main component, and the content by percentage of the noble metal component in the chip is greater than the content by percentage of the noble metal component in the electrode to which the chip is welded. In another example, the electrode may be formed of a metal with a noble metal as a main component, the content by percentage of the noble metal component in the electrode may be greater than the content by percentage of the noble metal component in the chip, and the difference in content by percentage may be 50 mass % or more. In this case, too, as the noble metal component is diffused at high temperature, holes enter the chip, whereby an operational effect similar to the operational effect according to the above embodiments can be obtained.

(c) In the above embodiments, the ground electrode 27 is joined to the tip end 26 of the metal shell 3. However, the ground electrode may be formed by machining a part of the metal shell (or a part of a tip end metal shell welded to the metal shell in advance) (see JP-A-2006-236906, for example).

(d) While, in the above embodiments, the tool engaging portion 19 has a hexagonal cross section, the shape of the tool engaging portion 19 is not limited to such shape. For example, the shape is Bi-HEX (modified dodecagon) [ISO22977: 2005 (E)] or the like.

DESCRIPTION OF REFERENCE SIGNS

1 Spark plug
5 Center electrode
27 Ground electrode
31 Ground electrode-side chip
32 Center electrode-side chip
33 Spark discharge gap (gap)
34, 35 Intermediate layer
38, 39 Hole
CL2, CL3 Central axis (of chip)

Having described the invention, the following is claimed:

1. A spark plug comprising:
a center electrode;
a ground electrode forming a gap with the center electrode; and
a chip welded to at least one of the electrodes,
wherein:
the chip has a thermal expansion coefficient smaller than a thermal expansion coefficient of the electrode to which the chip is welded;
the difference between the content A (mass %) of a noble metal component in the chip and the content B (mass %) of a noble metal component in the electrode (A−B) is 50 mass % or more;
a hole is present in an intermediate layer disposed between the chip and the electrode; and
in a cross section including a central axis of the chip, $0.1 \leq N/L \leq 0.4$, where L is the length (mm) of a boundary of the chip and the intermediate layer, and N is the length (mm) of the hole in a direction along the boundary of the chip and the intermediate layer.

2. The spark plug according to claim 1, wherein:
in the cross section, a range of the chip from one side to the other side is equally divided into four parts by straight lines P1, P2, and P3 in order from an end and parallel with the central axis; and
$0.6 \leq Q/N$, where Q (mm) is the length of the hole in the direction along the boundary in the range from P1 to P3.

3. The spark plug according to claim 1, wherein:

when, in a plane perpendicular to the central axis of the chip, the electrode to which the chip is welded and an end face of the chip positioned on the electrode side are projected along the central axis, an area in which a projection plane of the electrode and a projection plane of the end face are overlapped is rectangular or circular; and $K/T \geq 1.2$, where K (mm) is a long side of the rectangular area or a diameter of the circular area, and T (mm) is a maximum thickness of the chip along the central axis.

4. The spark plug according to claim 2, wherein:

when, in a plane perpendicular to the central axis of the chip, the electrode to which the chip is welded and an end face of the chip positioned on the electrode side are projected along the central axis, an area in which a projection plane of the electrode and a projection plane of the end face are overlapped is rectangular or circular; and $K/T \geq 1.2$, where K (mm) is a long side of the rectangular area or a diameter of the circular area, and T (mm) is a maximum thickness of the chip along the central axis.

* * * * *